US006485533B1

(12) United States Patent
Ishizaki et al.

(10) Patent No.: US 6,485,533 B1
(45) Date of Patent: Nov. 26, 2002

(54) POROUS GRINDING STONE AND METHOD OF PRODUCTION THEREOF

(75) Inventors: Kozo Ishizaki, 513-193, Nagamine-Machi, Nagaoke-Shi, Niigata 940-2142 (JP); Atsushi Takata, 1-1, Aobadai, 4-Chome, Nagaoka-Shi, Niigata 940-2145 (JP); Kazuyuki Kumeta, Nagaoka (JP)

(73) Assignees: Kozo Ishizaki, Nagaoka (JP); Atsushi Takata, Nagaoka ( * ) Notice: Subject to any disclaimer, the term of this patent is extended or adjusted under 35 U.S.C. 154(b) by 0 days.

(21) Appl. No.: 09/555,787

(22) PCT Filed: Dec. 3, 1998

(86) PCT No.: PCT/JP98/05460

§ 371 (c)(1),
(2), (4) Date: Jul. 31, 2000

(87) PCT Pub. No.: WO99/28087

PCT Pub. Date: Jun. 10, 1999

(30) Foreign Application Priority Data

Dec. 3, 1997 (JP) ..... 9-333137

(51) Int. Cl.[7] ..... B24D 3/00; B24D 3/10; B24D 3/18

(52) U.S. Cl. ..... 51/307; 51/309; 51/293; 51/296

(58) Field of Search ..... 51/307, 293, 296, 51/309; 451/540

(56) References Cited

U.S. PATENT DOCUMENTS 4,977,710 A * 12/1990 Une ..... 51/309
5,718,736 A * 2/1998 Onishi et al. ..... 51/309

FOREIGN PATENT DOCUMENTS

JP 7-251379 10/1995
JP 9-103965 4/1997

* cited by examiner

*Primary Examiner*—Michael Marcheschi
(74) *Attorney, Agent, or Firm*—Armstrong, Westerman & Hattori, LLP

(57) ABSTRACT

An abrasive-particle grinder and a method of manufacturing the grinder, in which the bonding force between super-abrasive particles and a binder is enhanced, attrition of the binder during a grinding process is increased, and physical properties of the grinder are improved. The grinder comprises super-abrasive particles as grinding particles and metal powder as a binder. The binder is formed into a porous body and then at least the surface thereof is denatured to ceramic. Protrusion of the abrasive particles is first controlled and then grip of the abrasive particles is controlled.

20 Claims, 2 Drawing Sheets

POROUS GRINDING STONE AND METHOD OF PRODUCTION THEREOF

TECHNICAL FIELD

The present invention relates to a porous super-abrasive grinder or whetstone for use in the field of precision machining. More particularly, the present invention relates to a porous super-abrasive grinder that ensures highly efficient work and has superior strength, and a method of manufacturing the grinder.

BACKGROUND ART

Grinding (abrasive) particles of diamond and cubic boron nitride (hereinafter also referred to as "cBN") are called "super-abrasive particles" because of having very high hardness, and are often used in precision grinding of steel, very hard metals, glass, ceramics, and stone materials. A super-abrasive grinder (hereinafter simply referred to as "grinder") using such super-abrasive particles is generally manufactured by binding the super-abrasive particles together by a binder and molding them into a desired shape. Depending on types of binders used, there are a resin bond grinder using a synthetic resin, a vitrified bond grinder using a vitreous material, and a metal bond grinder using a metal. These grinders are selectively employed in accordance with characteristics of works to be ground. Recently, with an increased density of devices and more widespread use of those devices as represented by integrated circuits employing thin film processes, it has been required from the economical reason to precisely grind a work to such an extent that a width of grinding allowance for a substrate is, e.g., not larger than 0.3 mm. A thin-edge grinding wheel capable of achieving the above grinding has been demanded correspondingly.

Of the above grinders, the metal bond grinder is manufactured by putting metal powder including abrasive particles scattered uniformly therein into a mold together with a metal base, and subjecting it to pressing and sintering (or hot pressing) processes. The binder of metal used in the metal bond grinder uses, for example, a Cu—Sn system, a Cu—Sn—Co system, a Cu—Sn—Fe—Co system, a Cu—Sn—Ni system or a Cu—Sn—Fe—Ni system or any of these systems to which phosphorus is added. Such a conventional metal bond grinder has an extremely strong binding strength as compared with conventional resinoid and vitrified bond grinders, and is therefore advantageous in exerting a sufficient abrasive-particle retention force required to perform strong grinding by means of super-abrasive particles. In the metal bond grinder, however, the strength and stickness of the binder itself are so high that the binder is not worn during the grinding process. Even when abrasive particles are worn, the abrasive particles cannot fall from the binder. This means that the dressing interval must be shortened and highly sufficient grinding is impossible. Accordingly, the conventional metal bond grinder has the following disadvantages. Since discharging of chips is deteriorated and loading occurs easily, the grinding resistance increases and the grinding quality deteriorates, so that the heat generated is increased. Further, the grinder has a tendency to unsuccessfully finish the surface of a work. It is therefore very difficult to perform grinding with high efficiency by increasing the infeed or increasing the contact area of the grinder and the work. In addition, the metal bond is softened to cause plastic deformation upon grinding, and loading takes place in the surface of the grinder.

Heretofore, most of thin-edge grinders for use in the precision grinding have been metal bond grinders from the viewpoint of strength. The metal bond grinder is manufactured by the electro-forming or sintering method using, as a binder, a Ni- or bronze-base alloy. However, the structure of a binder phase is dense and a difficulty is encountered in dressing the metal bond grinder. An intricate and expensive technique and apparatus employing the electrolytic method, etc. have been therefore required. To activate a grinder, it is required to project an edge of super-abrasive particles from the surface of the binder phase. Generally, a grinder just after being formed has a condition where the super-abrasive particles and the binder phase are at the same level in the surface of the grinder. To project an edge of the super-abrasive particles from such a condition, a surface layer of the binder phase must be removed to a certain depth while leaving the super-abrasive particles. This operation is called "dressing". If the surface layer of the binder phase is flat, it is very difficult to remove only the surface layer of the binder phase by a scraping or similar method, for example, while leaving the super-abrasive particles. This means the necessity of an intricate and expensive method, such as the electrolytic method, for ablating the surface layer of the binder phase.

On the other hand, a vitrified bond grinder is usually manufactured by molding a mixture of ceramic particles as a binder and super-abrasive particles, and sintering the molded mixture under pressure. Since a binder phase is porous and has a coarse structure, special dressing is not required. Also, since grinding chips generated during the grinding work are captured in pockets formed by pores and then discharged, loading does not easily occur. Further, even when an edge of the super-abrasive particles is worn, the binder phase is so coarse and brittle as to fall off in an appropriate manner. As a result, a new edge appears and glazing does not also easily occur. In the vitrified bond grinder, however, the binder phase is brittle and the bonding force between the binder and the super-abrasive particles is weak. Accordingly, the vitrified bond grinder cannot be formed into a grinder having a thin edge with a thickness of, for example, not greater than 0.3 mm, and the edge is easily susceptible to dulling. The vitrified bond grinder is therefore not economical when used to grind a difficult-to-grind work having high hardness under a strong pressure, because of serious wear.

In order to eliminate the above defects, a continuous porous metal bond grinder is proposed (Japanese Unexamined Patent Application Publication No. 59(1984)-182064). However, this metal bond grinder does not utilize the powder sintering method. More particularly, the Publication discloses a manufacturing method as follows. An inorganic compound that is melted by a solvent is sintered into a desired shape. Thereafter, voids in the sintered body are filled with abrasive particles and the sintered body having voids filled with abrasive particles is preheated. A melted metal or alloy is pressed into the voids of the sintered body filled with the abrasive particles and is then solidified. Subsequently, the inorganic compound is liquated out by a solvent. Thus, the disclosed method is to add, as filler, a pore forming agent and to form pores in a layer of the abrasive particles. Further, various measures for preventing a reduction in grinding quality have been proposed. In one example, many layers of metal coatings are formed on abrasive particles, and the coated abrasive particles are sintered by hot pressing so as to have a structure that is like a vitrified bond and includes pores formed therein (Japanese Examined Patent Application Publication No. 54(1979)-31727). Furthermore, a grinder using cast iron for the purpose of preventing loading of the grinder has been proposed (Japanese Unexamined Patent Application Publication No. 3(1991)-264263). The grinder using cast iron as a bond advantageously has great strength and high rigidity, enables heavy grinding to be performed at a high infeed, and is worn in the brittle fracture manner without the occurrence of plastic deformation, so that loading is less likely to occur. However, the bond of this grinder is too strong and accordingly the dressing property is deteriorated as compared with the bond of the copper system. Additionally, because of the high rigidity, it is difficult at the present to practically employ this grinder with the existing grinding machines and methods. By forming a large number of pores within the layer of the abrasive particles, a grinding liquid can be impregnated into the pores to enhance the cooling characteristics of the grinder, and the grinding resistance can be made small by the pores to improve the grinding quality. In other words, it can be expected that less heat is generated and the surface of a work is finished with high quality. However, when a large number of pores are formed in the conventional copper-system metal bond grinder, the strength and the abrasive- particle retention force are naturally reduced, so that the sufficient grinding performance cannot be obtained.

Moreover, in a grinder using non-porous cast iron as a bond, iron powder is added to cast iron powder because of the inferiority of the sintering characteristics of the cast iron powder, and a powder mixture is molded with the load of 8,000 kgf/cm$^2$ to 10.000 kgf/cm$^2$. With addition of the iron powder, the original brittle fracture characteristic of the cast iron is lost and plastic deformation is apt to occur in the same manner as the copper system bond. As a result, the characteristics of the cast iron are not utilized sufficiently. Additionally, if the abrasive particles directly contact the cast iron, diamond is lost upon reaction of iron and carbon. It is therefore required to coat diamond with a film for protection.

Taking into account the above-described state of the art, the inventors have accomplished an invention wherein pores are formed in the structure of a metal bond grinder to provide a porous structure, with the view of realizing a grinder that has great strength and a high binding force between a binder and super-abrasive particles (Japanese Unexamined Patent Application Publication Nos. 7(1995)-251378 and 7(1995)-251379). This porous metal bond grinder can be manufactured, for example, by mixing super-abrasive particles and binder metal particles together, compressing a mixture into a shape of the grinder with or without a heat-developing binder, and sintering a compressed body under such a temperature and pressure that the binder metal particles are bonded to each other while maintaining the particulate form, and the binder particles and the super-abrasive particles are bonded to each other. The porous metal bond grinder thus manufactured has been practiced with fairly satisfactory results because of the following advantages. The bonding force between the binder and the super-abrasive particles is strong, and the dressing property is good. Grinding chips, etc. generated during the grinding work are captured in pockets formed by pores and then discharged; hence loading does not easily occur. Further, even when an edge of the super-abrasive particles is worn, the binder phase is caused to fall off in an appropriate manner as a result of properly adjusting the sintering strength of the binder phase, so that a new edge appears and glazing does not also easily occur.

In the above porous metal bond grinder, however, the bonding force between the super-abrasive particles and the binder is strong, but the strength is within the range obtainable with a metal. Further, since the binder phase also includes a porous metal, there is a limitation in value of the Young's modulus. Thus, although the above metal bond grinder has succeeded in remarkably improving the grinding performance as compared with the existing grinders, problems still remain in that there is a room of improvement in the reaction between the super-abrasive particles and the binder and the material physical properties of the binder phase itself.

DISCLOSURE OF THE INVENTION

To overcome the above-mentioned problems, the inventors have conducted studies with intent of enhancing the bonding force between super-abrasive particles and a binder, increasing attrition of the binder during a grinding process, and improving physical properties of a grinder.

An object of the present invention is to provide a porous abrasive-particle grinder and a method of manufacturing the grinder, in which the bonding force between super-abrasive particles and a binder is strong, dressing, dulling, loading and glazing properties are improved in a well-balanced way, and the grinder has strength enough to be used as a thin-edge grinder for fine grinding.

The present invention has been made for achieving the above object, and will be described below in more detail.

The present invention resides in a porous abrasive-particle grinder comprising super-abrasive particles as grinding particles and metal powder as a binder, wherein the binder is formed into a porous body holding the super-abrasive particles with chemical and physical bonding, and at least the surface of the formed porous body is denatured to ceramic. Since the binder is formed into a porous structure phase having adjusted porosity and at least the surface of the formed porous body is denatured to ceramic, the porous abrasive-particle grinder has such characteristics that the bonding force between the super-abrasive particles and the binder is strong, dressing, dulling, loading and glazing properties are improved in a well-balanced way, and the grinder has strength enough to be used as a thin-edge grinder for fine grinding.

The abrasive particles are selected from a group consisting of materials with the Knoop hardness of not lower than 1000. More specifically, the abrasive particles are selected from a group consisting of diamond and cubic boron nitride. The super-abrasive particles have a mean particle size of not greater than 1000 $\mu$m.

The binder comprises a metal capable of chemically and physically bonding to the super-abrasive particles under heating, and the porous body has a porous structure phase formed by powder sintering. The above metal is one or more selected from a group consisting of Fe, Cu, Ni, Co, Cr, Ta, V, Nb, Al, W, Ti, Si and Zr. Porosity of the whole of the grinder is 5 to 60%, preferably 5 to 45%.

The present invention resides in a method of manufacturing a porous abrasive-particle grinder by using, as raw materials, super-abrasive particles as grinding particles and metal powder as a binder, wherein protrusion of the abrasive particles and grip of the abrasive particles are controlled separately.

Also, the present invention resides in a method of manufacturing a porous abrasive-particle grinder by using, as raw materials, super-abrasive particles as grinding particles and metal powder as a binder, wherein protrusion of the abrasive particles is first controlled and then grip of the abrasive particles is controlled.

The present invention resides in a method of manufacturing a porous abrasive-particle grinder, the method comprising the steps of mixing super-abrasive particles as grinding particles and metal powder as a binder together, molding a mixture into a predetermined size and shape, sintering a molding under temperature and pressure adjusted such that atoms are diffused at the interface between the super-abrasive particles and binder particles in the molding and the binder particles are sintered together into a porous body, and heating a sintered body in the presence of one or more kinds of gases selected from a group consisting of nitrogen, carbon and hydrogen so that at least the surface of the porous body is denatured to ceramic.

Super-abrasive particles having a mean particle size of not greater than 1000 $\mu$m are employed as the grinding particles. Super-abrasive particles selected from a group consisting of materials with the Knoop hardness of not lower than 1000 are employed as the grinding particles. Diamond and cubic boron nitride are employed as the materials with the Knoop hardness of not lower than 1000.

A metal capable of chemically and physically bonding to the abrasive particles under heating is used as the binder, and a porous body having a porous structure phase is formed by powder sintering. The above metal is one or more selected from a group consisting of Fe, Cu, Ni, Co, Cr, Ta, V, Nb, Al, W, Ti, Si and Zr. The sintering step is performed under temperature and pressure adjusted such that porosity of the whole of the grinder is 5 to 60%. Preferably, the sintering step is performed under temperature and pressure adjusted such that porosity of the whole of the grinder is 5 to 45%. The sintering step is performed by an electro-sintering process, and temperature and pressure in the sintering step are respectively in the range of 600° C. to 2000° C. and in the range of 5 MPa to 50 MPa. Alternatively, the sintering step is performed by a hot-press sintering process, and temperature and pressure in the sintering step are respectively in the range of 600° C. to 2000° C. and in the range of 5 MPa to 50 MPa. Any other suitable sintering methods such as atmosphere sintering and HIP sintering are also usable.

BEST MODE FOR CARRYING OUT THE INVENTION

Figure 1:
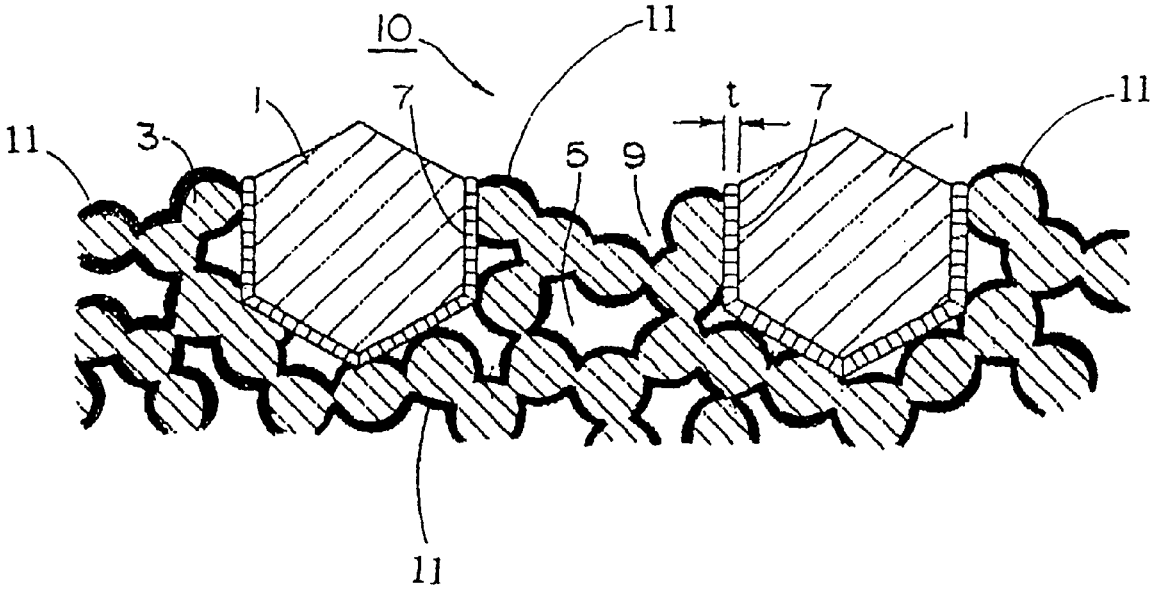
FIG. 1 is a schematic sectional view of a surface layer portion of a porous abrasive-particle grinder according to one embodiment of the present invention.

In a porous abrasive-particle grinder according to the present invention, abrasive particles having very high hardness, i.e., "super-abrasive particles", are selected as grinding particles and are preferably selected from materials with the Knoop hardness of not lower than 1000. More specifically, the abrasive particles are selected from a group consisting of diamond and cubic boron nitride. (cBN). Super-abrasive particles 1 used in the present invention are made of single-crystal or polycrystalline diamond, or single-crystal or polycrystalline cBN, or a mixture of two or more optionally selected from them. The super-abrasive particles have a mean particle size of not greater than 1000 $\mu$m.

In precision grinding of works such as ceramic materials, for example, diamond having the highest hardness is preferably used as the super-abrasive particles. The diamond may be single-crystal or polycrystalline, and may be natural or artificial diamond.

For iron-base works, it is preferable to use cBN because using diamond raises a problem. The cBN may also be single-crystal or polycrystalline.

A binder used together with the super-abrasive particles may be any material capable of developing chemical and physical bonding at the interface between the binder and the selected super-abrasive particles with chemical and physical bonding under heating.

The term "chemical and physical bonding" means such a state that the binder and the super-abrasive particles are bonded together in a diffusion junction phase formed of a eutectic mixture, a solid solution, or a compound upon atoms of the super-abrasive particles and the binder mixing with each other by thermal diffusion at the contact interface between them.

The binder is a metal that is preferably as a binder of a grinder for, in particular, precision grinder. The metal is one or more selected from a group consisting of single elements Fe, Cu, Ni, Co, Cr, Ta, V, Nb, Al, W, Ti, Si and Zr, which are denatured to ceramic and are hence given brittleness after sintering. The metal used as the binder is preferably in the form of powder having a mean particle size ranging from 5% to 50% of that of the super-abrasive particles.

If a particle size ratio of binder particles to the super-abrasive particles approaches 1:1, contact points between the super-abrasive particles and the binder particles would be reduced even in a maximally compacted state, and the binding force developed by sintering would be insufficient, thereby causing dulling or other drawbacks to occur easily. When the particle size ratio of the binder particles to the super-abrasive particles is in the range of 1:0.05–0.5, contact points between the super-abrasive particles and the binder particles would be sufficiently increased so that a diffusion junction phase is formed as a thin film covering substantially the entire surfaces of the super-abrasive particles by sintering, and the binding force between the super-abrasive particles and the binder is increased. In addition, an appropriate porosity is obtained.

If the particle size ratio of the binder particles to the super-abrasive particles is smaller than 1:0.05, there is no problem with the binding force developed by sintering because a sufficient number of contact points are formed between the super-abrasive particles and the binder particles. However, the porosity and pore size would be reduced so that a resulting sintered body is practically equal to a non-porous metal bond grinder.

When the binder is heated to the range of 300° C. to 2000° C., for example, in a condition where the binder and the super-abrasive particles contact with each other, atoms are diffused at the interface between them and a diffusion junction phase is formed of a eutectic mixture, a solid solution, or a compound. The super-abrasive particles and the binder are firmly bonded together with the diffusion junction phase. Accordingly, even when the grinder is deeply dressed to improve the grinding quality and a contact area between the super-abrasive particles and the binder, useless falling off of the super-abrasive particles during the grinding work does not easily occur. However, it has been found that, if a thickness of the fusion phase is too large, the diffusion junction phase would be likely to separate from the super-abrasive particles. The reasons are presumably in that excessive formation of the diffusion junction phase causes C of diamond or B of cBN to move to the contact interface in large amount, thereby forming a depletion layer, and that the diffusion junction phase is wrinkled due to generation of shift stresses in the horizontal direction and a thermal change, i.e., a difference in coefficient of thermal expansion between bodies of the super-abrasive particles and the diffusion junction phase.

From the above point of view, a thickness of the diffusion junction phase in the porous super-abrasive-particle grinder of the present invention is preferably controlled to fall in a certain range with respect to the abrasive particle size. The thickness of the diffusion junction phase can be controlled by adjusting a temperature and time applied when sintering a powder mixture of the super-abrasive particles and the binder. The temperature and time are varied depending on the types and size and the selected super-abrasive particles and the binder, the selected sintering method and apparatus, the selected pressure during sintering, etc. Therefore, a preferable temperature in practical use should be determined based on experiments. A generally selected range of temperature is 300° C. to 2000° C.

A description is now made of the case of using diamond as the abrasive particles and an iron-base metal as the binder. The iron-base metal may be powder of any kind of iron-base metal that is capable of chemically and physically bonding to diamond particles under heating. Generally, there are various kinds of iron materials including iron containing carbon less than a measurable limit (pure iron), carbon steel containing a small amount of carbon, and cast iron containing carbon of not less than 1.7%.

In the present invention, since the bonding strength is improved upon reaction with a carbon component of diamond, the iron-base metal powder is represented by cast iron. However, usable materials are not limited to cast iron only.

After performing sintering in such a manner that the iron-base metal reacts with the carbon component of diamond to improve the bonding strength and an appropriate porosity is obtained, a resulting sintered body is denatured to ceramic. With denaturaiton to ceramic, the iron-base metal is changed into an iron bond exhibiting the brittle fracture characteristic upon reaction of nitrogen or carbon, for example, and iron. The iron-base metal powder is therefore required with priority to have a property capable of chemically and physically bonding to the diamond particles and a property enabling the sintered body to have an appropriate porosity.

In the case of using diamond as the abrasive particles and an iron-base metal as the binder, a metal bond grinder comprising diamond as the abrasive particles and iron-base metal powder as the binder is obtained in such a state that a binder portion contains a large number of pores formed upon powder sintering and the abrasive particles are held by the iron-base metal as the binder with the chemical and physical bonding. After being formed into such a porous structure, at least the surface of the porous structure is denatured to ceramic Thus, in a metal bond grinder, the strength and attrition of a metal bond are adjusted by forming a large number of pores in the metal bond and denaturing at least the surface of the porous metal bond to ceramic. When denaturing the metal bond to ceramic, an extent of denaturation to ceramic can be adjusted depending on an amount and pressure of gas or a sintering temperature and time, whereby the Young's modulus can be freely controlled. As a matter of course, not only the surface but also the whole of the porous metal bond may be denatured to ceramic.

In the porous super-abrasive-particle grinder of the present invention, porosity of the whole of the grinder is adjusted to fall in the range of 5 to 60%, preferably 5 to 45%. In the present invention, the porosity of the whole of the grinder corresponds to porosity of the binder. The porosity is adjusted depending on the metal particle size, the molding conditions of the grinder, and the sintering conditions of the grinder. Adjustment of the porosity can also be utilized to control the mechanical strength and the abrasive-particle retention force of the metal bond.

Further, in the case of using diamond as the abrasive particles and a Ti-base metal as the binder in the grinder of the present invention, the Ti-base metal as the binder and the diamond are bonded together with the chemical reaction developed at the interface between them. More specifically, the diamond and the Ti-base metal produce a compound of TiC with the chemical reaction, whereupon the interface therebetween is denatured to ceramic. The mechanical strength, i.e., porosity, and the abrasive-particle retention force of a bond portion are controlled by adjusting the particle size of Ti-base metal powder, the sintering temperature and the sintering time. Denaturation to ceramic (e.g., TiN) of a porous metal bond (Ti) from at least the surface to the interior thereof can be adjusted by chemical treatment reaction using $N_2$ gas after being formed into a porous body. As a result, the abrasive- particle retention force can be freely controlled with the strength, rigidity (Young's modulus), and attrition (porosity) of the bond itself.

In a porous grinder using a cast iron bond, for example, a reacting portion between diamond and cast iron can be controlled, but characteristics of the bond portion itself depend on the mechanical characteristics of the cast iron. In other words, characteristics of the bond portion are determined by physical property values of the cast iron.

By contrast, the present invention is featured in that the strength, rigidity and attrition of the bond portion can be controlled by chemical reaction treatment, and that the bond portion can be denatured to ceramic.

When the super-abrasive particles and the binder particles are filled in a mold and sintered under pressure and temperature, a part of the binder particles is melted and the binder particles contacting the super-abrasive particles spread and wet over the surface of the super-abrasive particles. Accordingly, atoms of both the particles are mixed with each other by thermal diffusion so that a diffusion junction phase is formed of a eutectic mixture, a solid solution, or a compound. When the binder particles are contacted with each other, fusion occurs at contact surfaces of the binder particles and the binder particles are connected to each other at their necks, whereupon non-contact portions form continuous pores.

A mixing ratio of the super-abrasive particles to the binder particles in sintering is preferably set to be 1:3 to 2:1 by volume ratio. If a proportion of the super-abrasive particles is smaller than the ratio of 1:3, the grinding ability would be insufficient. If a proportion of the super-abrasive particles is larger than the ratio of 2:1, the density of the super-abrasive particles would be too high and the strength of the sintered boy would be lowered, thereby causing dulling or other drawbacks to occur easily.

Explanation of "porosity" is summarized below. The porosity of the porous super-abrasive-particle grinder of the present invention is preferably set to fall in the range of 5% to 60%, more preferably 5% to 45%. Among various grinders, a vitrified bond grinder has a maximum porosity as high as about 50% except for special cases. A porosity range practically used in many cases is approximately 35% to 45%. If the porosity approaches 50%, the strength of the grinder is fairly deteriorated, which may give rise to a risk of breakage of the grinder. From the viewpoints of sufficiently developing the original capability of the super-abrasive particles enough to achieve strong grinding and effectively utilizing expensive super-abrasive particles, however, it is basically desired that a proportion of the abrasive particles be set to a relatively low value, a metal bond having a strong abrasive-particle retention force be used as the binder in least necessary amount, and the porosity be set to a relatively large value. For an ordinary diamond grinder using a cast iron bond, porosity of the bond itself is nearly zero, and voids are formed through intervention of the abrasive particles or by adding a pore forming agent. By contrast, the porous super-abrasive-particle grinder of the present invention is featured in that the metal bond itself includes a number of pores. If the porosity of the whole of the grinder of the present invention is less than 5%, the bond strength would be fairly increased and an attrition characteristic of the iron-base metal could not be sufficiently developed. A lower limit of the porosity is therefore set to 5%. If the porosity is too high, the strength of the grinder is deteriorated, which may give rise to a risk of breakage. The porosity is therefore set to be not larger than 60%, preferably not larger than 45%.

The super-abrasive particle grinder of the present invention is formed in a porous structure. The porosity of the porous grinder is preferably set to fall in the range of 5% to 60%, more preferably 5% to 45%.

If the porosity is less than 5%, a pocket volume provided by pores would be insufficient and a coolant would not sufficiently circulate, thereby causing loading or other drawbacks to occur easily. If the porosity exceeds 45%, particularly 60%, physical properties of the binder phase would be deteriorated and dulling or glazing would be likely to occur. Further, if a thin-edge grinder is manufacture under such a condition, the grinder would tend to break easily.

When manufacturing the porous abrasive-particle grinder of the present invention, preferably, the binder is prepared in the form of powder and mixed with the super-abrasive particles, and a powder mixture is filled in a mold and then sintered under pressure so that the super-abrasive particles and binder particles are bonded to each other and the binder particles are bonded together. In this manufacturing process, the porosity can be adjusted to fall in a preferable range by controlling the respective mean particle sizes of the super-abrasive particles and the binder particles, the mixing ratio, and the pressure, temperature and time of sintering.

Explanation of "diffusion junction" is summarized below. In the porous super-abrasive-particle grinder of the present invention, super-abrasive particles are used as grinding particles and metal powder is used as a binder. The binder is formed into a porous body holding the super-abrasive particles with chemical and physical bonding. The term "chemical and physical bonding" means such a state that the binder and the super-abrasive particles are bonded together in a diffusion junction phase formed of a eutectic mixture, a solid solution, or a compound upon atoms of the super-abrasive particles and the binder mixing with each other by thermal diffusion at the contact interface between them.

The porous abrasive-particle grinder of the present invention comprises super-abrasive particles selected from a group consisting of diamond and cBN, for example, and having a mean particle size of not greater than 1000 $\mu$m, and a metal binder capable of chemically and physically bonding to the super-abrasive particles under heating, the binder being sintered into a porous body having continuous pores. Preferably, the "chemical and physical bonding" between the binder and the super-abrasive particles is formed at the interface between them, and a thickness of the diffusion junction phase is controlled to fall in a certain range with respect to an abrasive particle size "r". The diffusion junction phase is preferably formed by the super-abrasive particles and one or more selected from a group consisting of Ti, Ni, Fe, Si, Ta, W, Cr and Co. From the viewpoint of carbon concentration gradient between an ironbase metal and diamond, iron is able to contain carbon of about 6 to 7%. In other words, when iron has a carbon concentration of 3%, for example, the iron is able to further react with carbon of 3 to 4%. When diamond and iron powder are mixed and then sintered, the surface of the iron powder starts to partly melting and sintering begins upon reaching the sintering temperature. At this time, if the carbon content of the iron is less than an allowable limit, the iron is able to react with carbon positioned thereabout (diffusion junction).

The term "denaturation to ceramic" will be described below. It has been hitherto known that a cast-iron bond grinder has a demerit in having excessively great strength, while it has many merits such as having great strength and high rigidity, enabling heavy grinding to be performed at a high infeed, and exhibiting wear in the brittle fracture manner without the occurrence of plastic deformation, so that loading is less likely to occur. In the porous super-abrasive-particle grinder of the present invention, the binder is formed into the binder is formed into a porous body holding the super-abrasive particles with chemical and physical bonding, and thereafter at least the surface of the porous body is denatured to ceramic for adjusting the rigidity, i.e., the Young's modulus, of the grinder. Since the bonding strength of the metal bond is controlled depending on the porosity and a proportion at which the porous body is denatured to ceramic, it is easy to control the bonding strength such that the metal bond is appropriately worn in the grinding process without excessive resistance.

A method of manufacturing the porous super-abrasive-particle grinder of the present invention will be described below.

Super-abrasive particles as grinding particles and metal powder as a binder are mixed together and then molded into a predetermined size and shape. Thereafter, a molding is sintered under temperature and pressure adjusted such that atoms are diffused at the interface between the super-abrasive particles and binder particles in the molding and the binder particles are sintered together into a porous body. Subsequently, a sintered body is heated in the presence of one or more kinds of gases selected from a group consisting of nitrogen, carbon and hydrogen so that at least the surface of the porous body is denatured to ceramic. In the sintering step, the temperature and pressure are adjusted such that the porosity of the whole of the grinder is 5 to 45%. The sintering step is performed by an electro-sintering process, and the temperature and pressure in the sintering step are set respectively to fall in the range of 600° C. to 2000° C. and in the range of 5 MPa to 50 MPa. Any other suitable sintering methods, e.g., atmosphere sintering and HIP sintering, are also usable. Alternatively, the sintering step is performed by a hotpress sintering process, and the temperature and pressure in the sintering step are set respectively to fall in the range of 600° C. to 2000° C. and in the range of 5 MPa to 50 MPa. Likewise, any other suitable sintering methods, e.g., atmosphere sintering and HIP sintering, are also usable. The temperature and pressure applied in the sintering step are adjusted such that a diffusion junction phase is formed by the super-abrasive particles and the binder particles in thickness within an intended range at the interface between them. Further, the temperature and pressure applied in the sintering step are preferably adjusted such that the porosity is in the range of 5% to 45%.

Let now consider, for example, a reaction of Ti and C. TiC can be produced in a carbon atmosphere or vacuum at temperatures not lower than 700° C. Differences as compared with the case of using cast iron reside in not only concentration gradient, but also creation of a new product instead of a solid solution reaction between carbon and iron. Likewise, in the case of using tungsten (W), tungsten carbide (WC, also called superhard metal) is created at the interface between abrasive particles and a bond. With only a solid solution reaction, the strength of the grinder is not so changed as compared with the strength before the reaction. In the present invention, however, since a new product is created, particularly, since a metal is denatured to ceramic, the strength and Young's modulus are remarkably improved so that the grinder exhibits quite different characteristics.

Any of various known methods can be used for sintering. Of the known methods, an especially preferable one is an electro-sintering process.

The electro-sintering process can be performed using a known discharge plasma sintering apparatus or an electro-sintering machine. The known discharge plasma sintering apparatus comprises a die, an upper punch and a lower punch which are inserted in the die, a base supporting the lower punch and serving as one electrode when a pulse current is applied to flow through the punches, a base pressing the upper punch downward and serving as the other electrode when a pulse current is applied to flow through the punches, and a thermocouple for measuring a temperature of powder as a raw material held between the upper and lower punches. A separately provided energizing apparatus is connected to both the bases, and a pulse current for plasma discharge is applied to the upper and lower punches from the energizing apparatus. In the discharge plasma sintering apparatus thus constructed, at least a portion sandwiched between both the bases is accommodated in a chamber. The interior of the chamber is excavated into a vacuum and no atmosphere gas is introduced to the chamber.

A powder mixture of super-abrasive particles and binder particles is filled in a die formed into a predetermined shape of a grinder. The interior of the chamber is excavated into a vacuum and is replaced by an inert atmosphere gas. Thereafter, the powder mixture is compressed under pressure by both the punches from above and below, and a pulse current is then applied. With the discharge plasma sintering process, the raw-material powder can be evenly and quickly raised to the sintering temperature by adjusting the energization current. It is also possible to perform temperature control in a strict manner.

One example of the discharge plasma sintering apparatus, which can be used to implement the above-described discharge plasma sintering process, is a discharge plasma sintering apparatus of Model SPS-2050 made by Sumitomo Coal Mining Co., Ltd.

In addition to the discharge plasma sintering process, other suitable methods such as hot-press sintering and HIP (Hot Isostatic Press), which is often used in sintering of ceramic powder, can also be used advantageously.

<Diffusion Junction Phase>

The abrasive-particle retention force is controlled such that the abrasive particles are prevented from falling off until they are worn out, by creation of a diffusion junction phase formed of a eutectic mixture, a solid solution, or a compound with chemical and physical bonding of the super-abrasive particles to the binder, i.e., upon atoms of the super-abrasive particles and the binder mixing with each other by thermal diffusion at the contact interface between them.

<Porosity>

In a grinder, generally, because the bonding strength of the binder is controlled such that the binder is appropriately worn in the grinding process without excessive resistance, pores are effective to suppress loading and improve the grinding quality of the grinder. Also, pores act to dissipate a large amount of grinding heat generated in the grinding step. In the case where a problem of grinding burn is to be avoided, a grinder is required to have a high porosity. A grinder including large-sized pores, which are intentionally formed in addition to usual pores, is also often employed.

If the porosity is too low, the retention force of retaining abrasive particles would be so strong that the abrasive particles worn out in edges cannot fall off from a binder metal and remain there. As a result, the grinding ability of the grinder would be deteriorated. If the porosity is too high, the retention force of retaining the abrasive particles would be so weak that the number of abrasive particles falling off from the binder metal is increased. As a result, the grinder would be increasingly worn out and the life of the grinder would be shortened.

The bonding strength of the metal bond is therefore controlled such that the porosity does not become too low and the retention force of retaining the abrasive particles does not become too strong.

<Denaturation to Ceramic>

Cast iron used in a cast-iron bond grinder is featured in not only having great strength, but also exhibiting brittle fracture. In a grinder using a metal bond of copper system, a bond component is cause to coat the surfaces of abrasive particles upon plastic deformation and the grinding quality is deteriorated due to the occurrence of loading. On the other hand, the cast-iron bond exhibits brittle fracture and is therefore effective in preventing loading. To make use of such an advantage of the cast-iron bond that loading is less likely to occur, the disadvantage of having too great strength must be overcome with adjustment of the strength.

To that end, in the present invention, the binder surrounding the abrasive particles is sintered into a porous structure that contains the numerous pores, and the abrasive particles are held by the binder metal with chemical and physical bonding. After that, at least a surface portion of the porous structure of the binder is denatured to ceramic so as to increase brittleness of the binder.

By adjusting the Young's modulus based on the porosity and an extent of denaturation to ceramic so that the metal bond is appropriately worn in the grinding process without excessive resistance, the grinding accuracy can be controlled.

Hereinafter, an embodiment of the present invention will be described in conjunction with Examples by referring to the drawings.

EXAMPLE 1

FIG. 1 schematically shows the structure of a porous super-abrasive-particle grinder of Example 1.

Referring to FIG. 1, numeral 10 shows the structure of a surface layer portion of the grinder. In the grinder 10 of this Example, super-abrasive particles 1 made of diamond single crystals having mean particle sizes of 20 $\mu$m to 30 $\mu$m (#660) are fixedly held by a binder 3 that is made of a single element, i.e., Ti, capable of binding with the super-abrasive particles 1 to form a diffusion junction phase under heating.

A number of continuous pores 5 are formed in a phase of the binder 3 (binder phase) so that the grinder 10 is a porous body having porosity in the range of 5% to 60%, specifically 29%. The surface of the binder phase is denatured to ceramic, thereby forming a ceramic phase 11. At the contact interface between the super-abrasive particles 1 and the binder 3 in the grinder 10, a diffusion junction phase 7 is formed due to atom diffusion occurred from one or both of the super-abrasive particles 1 and the binder 3. The diffusion junction phase 7 has a thickness "t" not larger than 1.5 μm, specifically 0.43 μm in this Example.

In the grinder of this Example, since the super-abrasive particles 1 and the binder 3 are firmly bonded each other by the diffusion junction phase 7 having the thickness restricted as mentioned above, the super-abrasive particles 1 are avoided from falling off uselessly during the grinding work.

Also, since the phase of the binder 3 is porous and has a rough surface, dressing of the grinder is automatically performed during the grinding work with no need of using any intricate means such as electrolyte dressing. In addition, because of a high porosity, edges of the super-abrasive particles 1 are protruded high beyond a surface level of the binder 3, and a grinder having the good grinding quality can be obtained.

Further, in the grinder 10, since the phase of the binder 3 has a porous structure including continuous pores, a coolant can be circulated through the pores 5 and therefore a cooling effect can be enhanced. Additionally, pockets 9 formed on the grinder surface by the pores 5 acts to capture grinding chips, etc. generated during the grinding work and to discharge them outside the system. As a result, loading is less likely to occur.

Moreover, since at least the surface portion of the binder phase is denatured to ceramic so as to form the ceramic phase 11 and is given a property to wear in a brittle fracture manner specific to ceramics, the binder is appropriately worn in the grinding process without excessive resistance.

Furthermore, because of the presence of the pores 5 and the ceramic phase 11 making the binder 3 brittle to some extent, when the grinder is subjected to grinding to such an extent that the edges of the super-abrasive particles 1 are worn out, the worn-out super-abrasive particles 1 and a part of the binder 3 bonded to them in surrounding relation through the diffusion junction phase 7 are torn off together and glazing is prevented. Simultaneously, since an outermost layer of the grinder is removed, the super-abrasive particles 1 residing in an inner layer newly appear to the surface and the grinding performance of the grinder 10 is maintained.

EXAMPLE 2

Manufacture of the Porous Super-abrasive-particle Grinder 10 of Example 1.

The super-abrasive particles 1 made of artificial diamond single crystals of #660 and Ti powder having purity of not less than 99.5% and a mean particle size of 5 μm were mixed at a volume ratio of 3 (super-abrasive particles):4 (binder). A resulting powder mixture was filled in a donut-shaped die of a discharge plasma sintering apparatus and then sintered under conditions of 800° C., 10 MPa and 5 minutes. A donut-shaped disk-like sintered body having an outer diameter of 92 mm, an inner diameter of 40 mm and a thickness of 0.3 mm was obtained.

Figure 2:
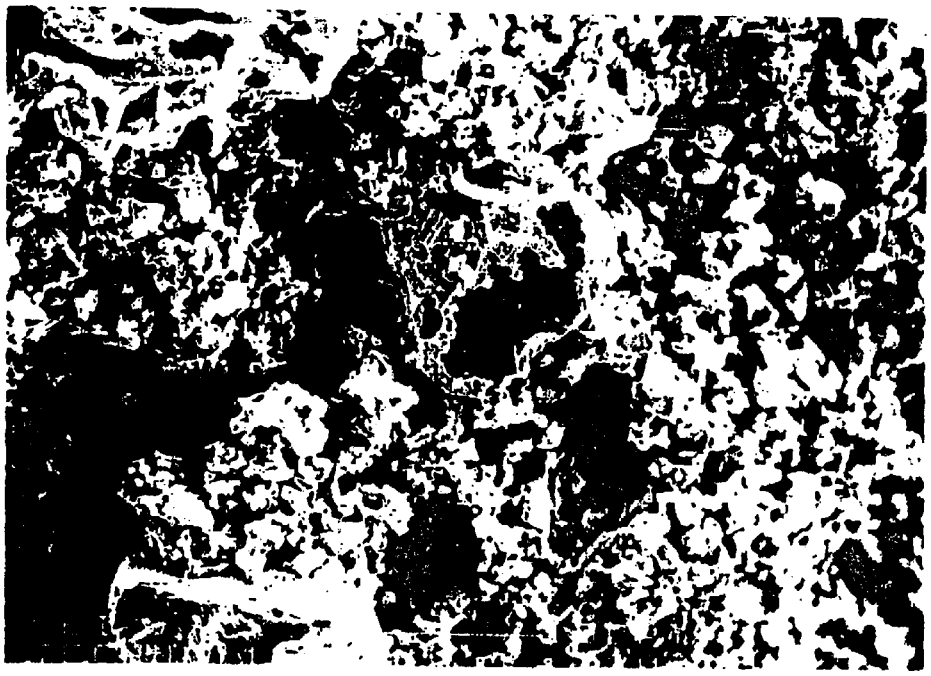
FIG. 2 is a photograph, instead of a drawing, of a sample of the porous abrasive-particle grinder before being subjected to nitriding treatment, the photograph being taken by an electron microscope for confirming a structure comprising diamond appearing at the center and small powder Ti around the diamond.
Figure 3:
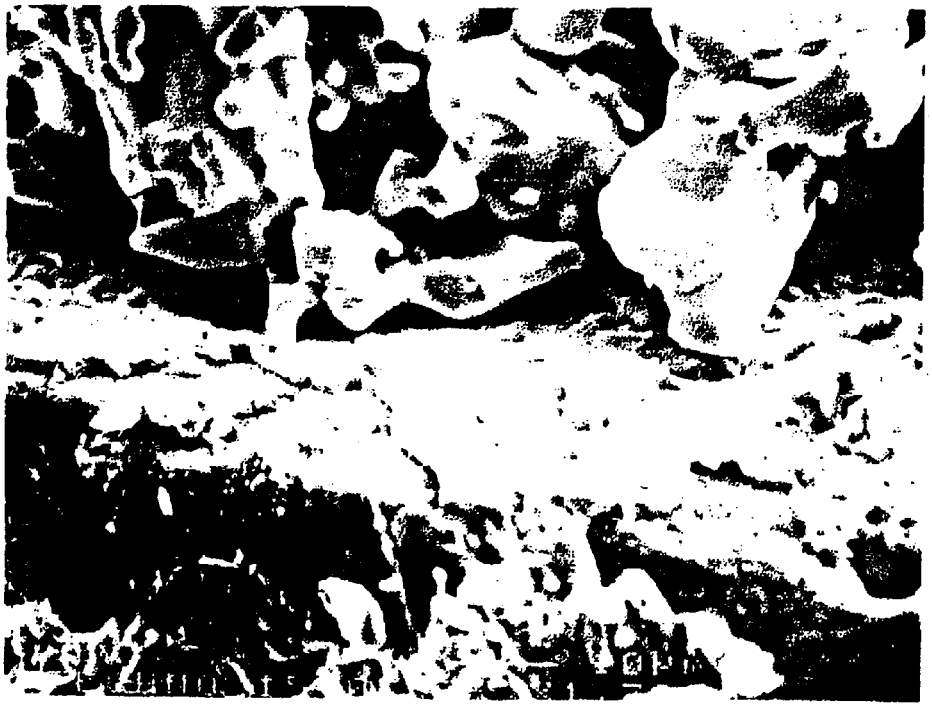
FIG. 3 is an enlarged photograph of a part of FIG. 2.

Viewing the sintered body prior to nitriding treatment in a photograph (FIG. 2) taken by an electron microscope, diamond appearing at the center and small powder Ti around the diamond are confirmed. Regarding a reaction between diamond abrasive particles and Ti, it is also confirmed from an enlarged photograph (FIG. 3) of part of FIG. 2 that bonding between Ti powder particles and bonding between the diamond abrasive particles and Ti are created based on the reaction between the diamond abrasive particles and Ti.

Then, the sintered body was heated under a nitrogen atmosphere for denaturing the surface of the binder to ceramic (titanium nitride), whereby the grinder 10 of Example 1 was obtained.

The grinder thus manufactured had porosity of 29%. A thickness of the diffusion junction phase 7 was measured to be about 0.1 μm by using an electron microscope. At the interface corresponding to the diffusion junction phase 7, TiC (titanium carbide) was confirmed. No gap was found at the interface between the super-abrasive particles 1 and the diffusion junction phase 7. Further, it was confirmed that a surface portion of the Ti sintered body was denatured to ceramic (titanium nitride).

EXAMPLE 3

A cutting test was conducted in accordance with the predetermined grinding method by using the super-abrasive-particle grinder of Example 1 as a sample in a tool grinding machine. Dressing of the grinder was made using a stick of GC #240. A block made of AlTiC ($Al_2O_3$.TiC) (bending strength; 588 MPa, Vickers hardness; 19.1 GPa) and having a section of 2 mm×5 mm was employed as a work.

Comparative Example 1

A cutting test was conducted in the same manner as Example 3 by using, as a sample, the super-abrasive-particle grinder of Example 1 except that the binder was not denatured to ceramic.

Comparative Example 2

As a comparative test, a donut-shaped disk-like metal bond grinder having an outer diameter of 92 mm, an inner diameter of 40 mm and a thickness of 0.3 mm was manufactured by the electrodeposition method using the same super-abrasive particles and the binder as in Example 1, and then dressed with ELID. A cutting test was conducted in the same manner as Example 3 by using the metal bond grinder thus prepared.

The sample of Example 1 was able to cut the work at a grinding rate 3.0 times and 1.5 times the rates obtainable with, respectively, Comparative Examples 1 and 2. This result shows that the grinder of Example 1 has much superior grinding efficiency than the conventional metal bond grinder.

EXAMPLE 4

The super-abrasive particles 1 made of CBN abrasive particles of #600 and Ti powder having purity of not less than 99.9% and a mean particle size of 2 μm were mixed at a volume ratio of 3 (super-abrasive particles):4 (binder). A resulting powder mixture was filled in a donut-shaped die of a discharge plasma sintering apparatus and then sintered under conditions of 800° C., 10 MPa and 5 minutes. A donut-shaped disk-like sintered body having an outer diameter of 92 mm, an inner diameter of 40 mm and a thickness of 0.3 mm was obtained. Then, the sintered body was heated under a nitrogen atmosphere for denaturing the surface of the binder to ceramic (titanium nitride), whereby a grinder was obtained. The interface between the CBN abrasive particles and the binder was analyzed by X-ray diffraction and EPMA (electron probe micro-analyzer). As a result, precipitation of titanium boride ($TiB_2$) was confirmed. It was also confirmed that Ti in a portion of the binder was denatured to titanium nitride (TiN) due to nitriding treatment. Thus, the grinder had such a structure that the CBN abrasive particles were held by titanium boride ($TiB_2$) and a skeleton was formed by a titanium nitride (TiN) bond.

EXAMPLE 5

A cutting test was conducted in accordance with the constant-pressure grinding method by using the super-abrasive-particle grinder of Example 4 as a sample in a tool grinding machine. Dressing of the grinder was made using a simple brake truer of GC #240. A block made of high speed steel having a section of 2 mm×5 mm was employed as a work. The cutting test was conducted in accordance with the predetermined grinding method by using a tool grinding machine.

Comparative Example 3

A cutting test was conducted in the same manner as Example 5 by using, as a sample, the super-abrasive-particle grinder of Example 4 except that the binder was not denatured to ceramic.

Comparative Example 4

As a comparative test, a vitrified grinder containing the same super-abrasive particles as in Example 4 at the same proportion was manufactured, and a cutting test was conducted in the same manner as Example 5 by using the vitrified grinder thus manufactured.

The sample of Example 4 was able to cut the work at a grinding rate about 2 times and about 5 times the rates obtainable with, respectively, Comparative Examples 3 and 4. This result shows that the grinder of Example 4 has much superior grinding efficiency than the vitrified grinder.

INDUSTRIAL APPLICABILITY

A porous diamond grinder using a ceramic bond, which has the intended strength and porosity, can be provided. Also, a porous diamond grinder using a ceramic bond, which enables grinding to be continued for a long period without loading, can be provided. Further, a grinder can be provided which has better grinding quality and can realize higher-precision grinding than a vitrified bond grinder, and which is less worn than a resinoid bond grinder. Since the grinder of the present invention is satisfactorily usable in universal grinding machines and has a superior dressing property, it can be subjected to dressing on the grinding machines as with the vitrified and resinoid bond grinders. In addition, a grinding ratio is high and therefore a grinding cost can be remarkably cut down.

What is claimed is:

1. A porous abrasive-particle grinder comprising:

super-abrasive particles as grinding particles and metal powder as a binder, wherein said binder is formed into a porous body holding said super-abrasive particles with chemical and physical bonding, and at least the surface of said binder is converted to ceramic compound.

2. A porous abrasive-particle grinder according to claim 1, wherein said super-abrasive particles has a Knoop hardness of not lower than 1000.

3. A porous abrasive-particle grinder according to claim 2, wherein said super-abrasive particles are selected from the group consisting of diamond and cubic boron nitride.

4. A porous abrasive-particle grinder according to claim 1, 2 or 3, wherein said binder comprises a metal which chemically and physically bonds to said super-abrasive particles under heating, and said porous body has a porous structure phase formed by powder sintering.

5. A porous abrasive-particle grinder according to claim 4, wherein said metal is one or more selected from a group consisting of Fe, Cu, Ni, Co, Cr, Ta, V, Nb, Al, W, Ti, Si and Zr.

6. A porous abrasive-particle grinder according to any one of claims 1 to 3, wherein the grinder has a porosity between 5–60%.

7. A porous abrasive-particle grinder according to claim 6, wherein the grinder has a porosity between 5–45%.

8. A method of manufacturing a porous abrasive-particle grinder by using super-abrasive particles as grinding particles and metal powder as a binder, comprising the step of:

controlling bonding strength of super-abrasive particles by converting the surface of said binder to ceramic compound separately from a step of forming said binder into a porous body.

9. A method of manufacturing a porous abrasive-particle grinder according to claim 8, wherein protrusion of said super-abrasive particles is first controlled and then bonding strength of said super-abrasive particles is controlled.

10. A method of manufacturing a porous abrasive-particle grinder, said method comprising the steps of:

mixing super-abrasive particles as grinding particles and metal powder as a binder together to form a mixture;

molding the mixture into a shape of the grinder;

sintering the molded mixture under temperature and pressure adjusted such that atoms are diffused at the interface between said super-abrasive particles and binder particles in said molding and said binder particles are sintered together into a sintered porous body; and heating the sintered porous body in an atmosphere comprising one or more selected from a group consisting of nitrogen, carbon and hydrogen so that at least the surface of said binder is converted to ceramic compound.

11. A method of manufacturing a porous abrasive-particle grinder according to claim 10, wherein said super-abrasive particles have a Knoop hardness of not lower than 1000.

12. A method of manufacturing a porous abrasive-particle grinder according to claim 11, wherein said super-abrasive particles are selected from the group consisting of diamond and cubic boron nitride.

13. A method of manufacturing a porous abrasive-particle grinder according to claim 10, 11, or 12, wherein said metal powder chemically and physically bonds to said super-abrasive particles under heating, and a porous body having a porous structure is formed by powder sintering.

14. A method of manufacturing a porous abrasive-particle grinder according to any one of claims 10 to 12, wherein said metal powder comprises one or more selected from a group consisting of Fe, Cu, Ni, Co, Cr, Ta, V, Nb, Al, W, Ti, Si and Zr.

15. A method of manufacturing a porous abrasive-particle grinder according to claim 10, wherein said sintering step is performed under temperature and pressure adjusted such that the grinder has a porosity between 5–60%.

16. A method of manufacturing a porous abrasive-particle grinder according to claim 15, wherein said sintering step is performed under temperature and pressure adjusted such that the grinder has a porosity between 5–45%.

17. A method of manufacturing a porous abrasive-particle grinder according to any one of claims 10 to 12, wherein said sintering step is performed by a discharge plasma sintering process, and the temperature and the pressure in said sintering step are in the range of 300° C. to 2000° C. and in the range of 5 MPa to 50 Mpa, respectively.

18. A method of manufacturing a porous abrasive-particle grinder according to any one of claims 10 to 12, wherein said sintering step is performed by a hot-press sintering process, and the temperature and the pressure in said sintering step are in the range of 300° C. to 2000° C. and in the range of 5 MPa to 50 Mpa, respectively.

19. A method of manufacturing a porous abrasive-particle grinder according to claim 10, further comprising the step of:

controlling bonding strength of super-abrasive particles by converting the surface of said binder to ceramic compound separately from a step of forming said binder into a porous body.

20. A method of manufacturing a porous abrasive-particle grinder according to claim 10, wherein protrusion of said super-abrasive particles is first controlled and then bonding strength of said super-abrasive particles is controlled.

* * * * *